United States Patent [19]

Nelson

[11] 4,138,951

[45] Feb. 13, 1979

[54] PORTABLE, COLLAPSIBLE TABLE

[76] Inventor: Marguerite D. Nelson, 310 NW. 5th Ave., Portland, Oreg.

[21] Appl. No.: 859,046

[22] Filed: Dec. 9, 1977

Related U.S. Application Data

[63] Continuation-in-part of Ser. No. 792,691, May 2, 1977.

[51] Int. Cl.[2] ..... A47B 3/00

[52] U.S. Cl. ..... 108/115; 108/157

[58] Field of Search ..... 229/8, 42, 41 B, 41 C, 229/41 D; 108/115, 157; D6/178, 27; 33/1 AA, 1 N, 1 B, 8, 10; 297/442, 439, 462; 312/140.2

[56] References Cited

U.S. PATENT DOCUMENTS

| | | | |
|---|---|---|---|
| 495,242 | 4/1893 | Jones | 33/1 AA |
| 2,390,546 | 12/1945 | Mather | 108/115 |
| 2,457,536 | 12/1948 | Doggett et al. | 312/140.2 |
| 2,550,959 | 1/1951 | Bowman | 297/442 |
| 2,974,841 | 3/1961 | Van Leer | 229/8 X |
| 3,702,170 | 11/1972 | Adams | 229/42 X |
| 3,702,675 | 11/1972 | Bajo | 229/8 X |
| 3,717,377 | 2/1973 | Johnson | 297/442 |

FOREIGN PATENT DOCUMENTS

| | | | |
|---|---|---|---|
| 455,999 | 11/1936 | United Kingdom | 297/442 |

*Primary Examiner*—James T. McCall

[57] ABSTRACT

An open-ended tubular pedestal member has front and rear walls joined by opposite side walls. The front and rear walls have an inward recessed configuration to provide reinforcement as well as to form foot spaces. Such walls in one embodiment are held in recessed configuration by a connector strip removably attached between the front and rear walls. A top wall has depending side tabs which project into the tubular pedestal member adjacent respective side walls or if desired the top can be secured at one side to the pedestal and at the other side have the depending tab. The recessed configuration of the front and rear walls extends fully to the side walls to form acute angular portions at the juncture therebetween and the depending tab or tabs on the top wall have a fitted engagement in such acute angular portions. The pedestal member and the top wall have bend lines so as to be foldable into a compact, flat package for shipment and storage.

1 Claim, 11 Drawing Figures

PORTABLE, COLLAPSIBLE TABLE

REFERENCE TO PRIOR APPLICATIONS

This application is a continuation-in-part of application Ser. No. 792,691, filed May 2, 1977.

BACKGROUND OF THE INVENTION

This invention relates to new and useful improvements in table constructions and pertains particularly to portable, collapsible type tables.

It is desirable at times to have a large surface such as for use by seamstresses in placing material thereon or for other purposes such as serving tables, display tables, and the like. It is usually desirable that such large tables, especially when used in the home, be capable of being easily stored since their use is usually only temporary. Furthermore, it is desired that such tables be inexpensive and also that they be light in weight so as to be readily handled.

SUMMARY OF THE INVENTION

According to the present invention and forming a primary objective thereof, a table structure is provided which while providing a relatively large top surface is light in weight so as to be portable and also is collapsible for compact storage.

The objectives of the invention are carried out by structure employing an open ended tubular pedestal member formed of a single blank of material and arranged to be shaped into a structurally strong support having front and rear walls and connected side walls. The front and rear walls have a recessed configuration and form acute angular portions at their juncture with the side walls. A top wall in one embodiment has downwardly depending tabs at its ends which fit in the acute angular portions to hold the top wall in place and to reinforce the tubular member. In another embodiment one end of the top wall is secured to the top of a side wall and its other end has a depending tab which fits in the acute angular portion. Connector means which may or may not be used extend longitudinally between the front and rear walls for holding them in their particular shape.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figure 2:
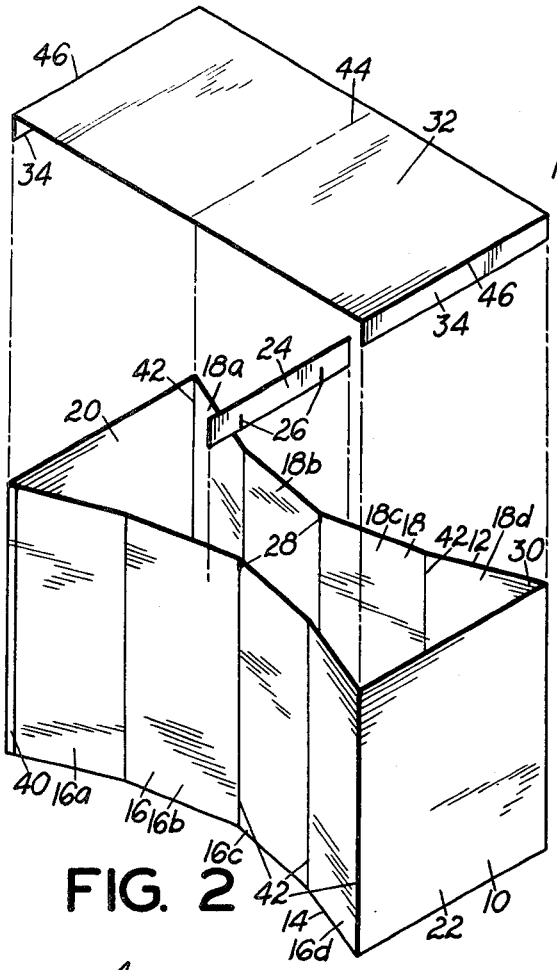
FIG. 2 is an exploded view of the table of FIG. 1.
Figure 1:
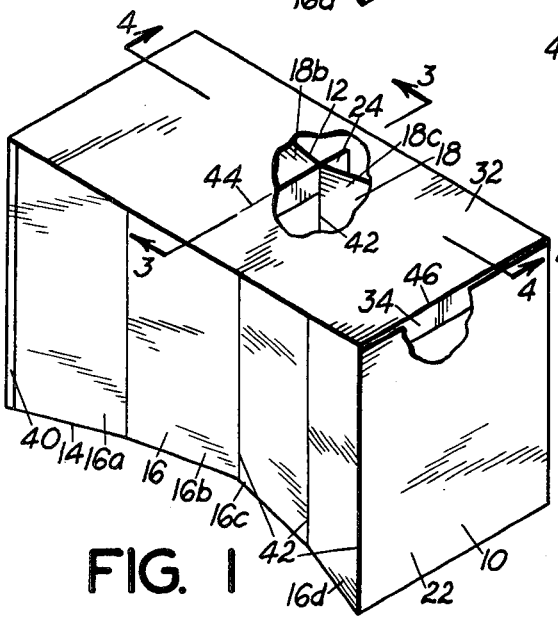
FIG. 1 is a perspective view of a table including features of a first embodiment of the present invention, a portion of this view being broken away.
Figure 3:
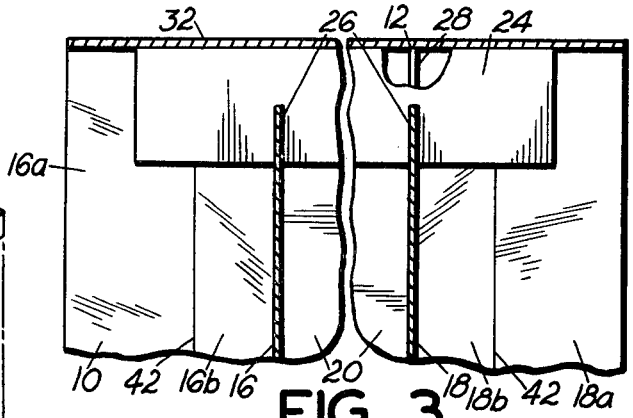
FIG. 3 is a foreshortened vertical sectional view, partly broken away, taken on the line 3—3 of FIG. 1.
Figure 4:
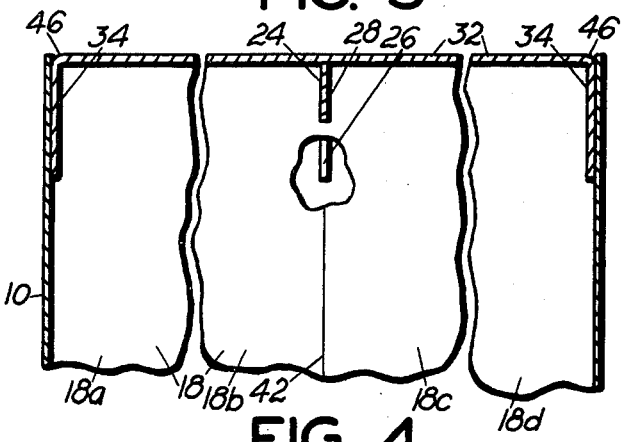
FIG. 4 is a foreshortened vertical sectional view, partly broken away, taken on the line 4—4 of FIG. 1.

With reference to the drawings and first to the embodiment of FIGS. 1–6, the present table comprises a corrugated cardboard pedestal member 10 of tubular construction, FIGS. 1–4. This member is open at the top and bottom ends 12 and 14, respectively, the bottom end serving as a support for the table on a supporting surface. The pedestal member has front and rear walls 16 and 18, respectively, joined to opposite side walls 20 and 22.

The front and rear walls 16 and 18, respectively, are recessed inwardly. This shape is maintained by a longitudinal corrugated cardboard connector strip 24 having bottom slots 26 which engage in top slots 28 in the tubular member 10 in an arrangement such that the top edge of the strip 24 is substantially level with the top edge 12 of the pedestal member 10. The connector strip 24 is located approximately centrally between the side walls. The recessed configuration of the front and rear walls extends fully to the juncture of such walls with the side walls whereby the juncture portions interiorly of the pedestal comprise acute angles 30.

The table includes a cardboard top wall 32 having depending side tabs 34. To assemble the table, the connector strip 24 is attached to the top of the tubular member 10 by engagement of slotted portions 26 and 28, and the top 32 is seated on the pedestal member 10 with the downturned tabs 34 fitted down in the angular corner portions 30. The tabs 34 have a selected longitudinal length so as to fit rather snugly within the corners of the pedestal member whereby to hold the table top firmly against horizontal movement. In addition, the acute angular shape of the corner portions 30 holds the tabs 34 in substantially vertical relation. The tubular construction of the pedestal member, together with its inwardly recessed front and rear walls, provide a sturdy and rugged table. Reinforcement is also provided by the connector strip 24 and the downturned tabs 34 of the top wall. The table will support a substantial weight even if constructed of a lightweight material. In this latter regard, while the parts of the table are stated to be constructed of corrugated cardboard, they may be constructed of any other suitable lightweight material. Such lightweight construction allows the table to be readily moved about and otherwise handled. The inwardly recessed front and rear walls allow a person to stand up close to the table.

Figure 5:
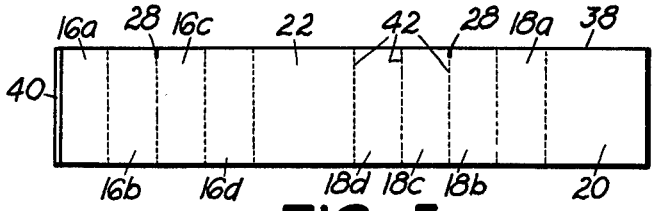
FIG. 5 is a plan view in reduced scale of a blank of material for forming a portion of the table of FIG. 1.

With reference further to FIG. 5, the tubular pedestal member 10 is formed from a single blank 38 of material and is secured in tubular form by a strip of gummed tape 40 or other securing means at one corner. To provide for folding and shaping of the tubular portion at the corners and to form the inward curvature at the front and rear walls, the front wall 16 has a plurality of panels **16*a*, 16*b*, 17*c* and 16*d*. Likewise, the rear wall has a similar arrangement of panels 18*a*, 18*b*, 18*c* and 18*d*. These panels and the three corners are formed by bend lines 42. The top wall 32 has a longitudinal bend line 44 centrally between its sides which allows it to be folded in half, and the tabs 34 have bend line connections 46** with the top wall.

Figure 6:
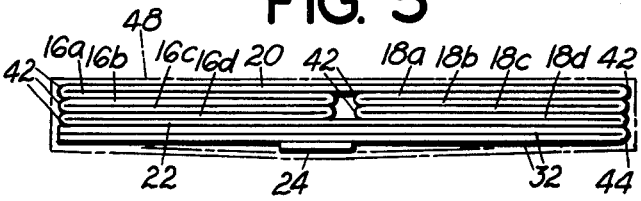
FIG. 6 is a top edge view of the table of FIG. 1 in folded flat condition and contained in a package.
Figure 7:
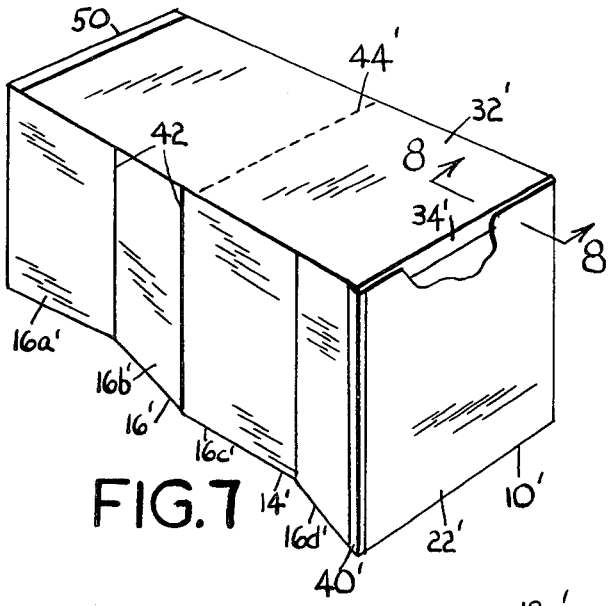
FIG. 7 is a perspective view of a table having features of a second embodiment of the invention, a portion of this view being broken away.
Figure 8:
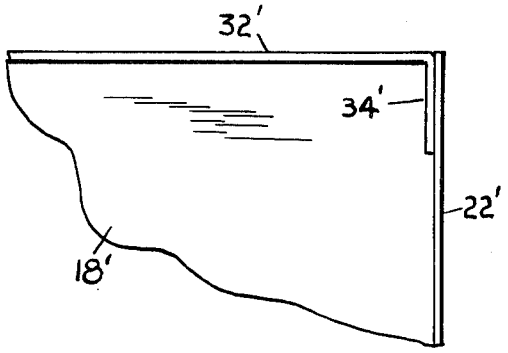
FIG. 8 is an enlarged fragmentary sectional view taken on the line 8—8 of FIG. 7.
Figure 9:
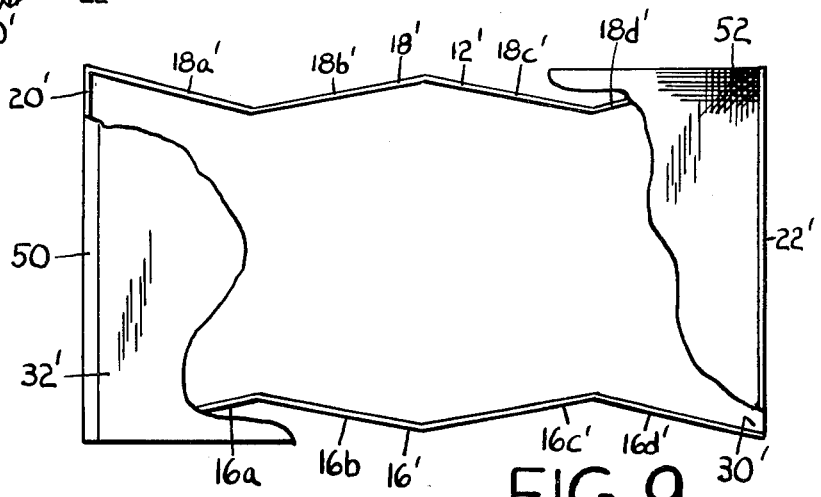
FIG. 9 is a top plan view of the table with a top portion thereof broken away.

By means of the structure described herein, the pedestal member 10 can when separated from the top wall 32 and connector strip 24 be folded into a flat, compact package. This is accomplished by moving the side walls 20 and 22 toward each other and allowing the panel sections of the front and rear walls 16 and 18, respectively, to fold like an accordion. Such a folded condition of the pedestal member is shown in FIG. 6 wherein it can be packaged flat in a container 48 shown in broken lines. The top wall 32 can be folded double on bend line 44 with the tabs 34 straightened out, and such provides a flat structure capable of being packaged in the same container as the pedestal member. Likewise, the connector strip 24 may be stored in the same package.

In setting up the table, the pedestal member is merely expanded and the connector strip 24 installed. The top wall 32 is then placed on top of the pedestal member with the tabs 34 projecting down into the acute angular portions 30. Such assembled structure provides a lightweight, portable, inexpensive and collapsible table which can provide a large surface area for many uses.

With reference now to FIGS. 7–11, a second embodiment of the table comprises a pedestal member 10' of tubular construction and open at the top and bottom ends 12' and 14', respectively. The pedestal member has front and rear walls 16' and 18', respectively, joined to opposite side walls 20' and 22'. The front and rear walls 16' and 18' are recessed inwardly to provide foot room at the table. Such walls as recessed are zig zag or accordion shaped for vertical strength.

The table of this embodiment includes a cardboard top wall 32' secured to side wall 20' by a connecting strip 50 of adhesive backed tape or other connecting strip means which provides a sturdy connection between the top wall 32' and the side wall 20' but which allows for relative pivotal movement of these two members.

The free end of top wall 32' has a depending side tab 34' arranged to fit in the inner junction area between the front and rear walls and the side wall 22'. The recessed configuration of the front and rear walls extends fully to the juncture of such walls with the side walls so that the juncture area comprises acute angles 30'. To assemble the table, the pedestal member 10' is expanded into its tubular shape and then the top by hinged movement on its connecting strip 50 laid on top of the pedestal member. The downturned tab 34' is fitted into the angular corner 30'. Similar to the embodiment of FIG. 1, the tab 34' has a selected longitudinal length so as to fit rather snugly within the corners of the pedestal member whereby to hold the table top firmly against horizontal movement, the acute angular shape of the corner portions 30' similarly holding the tab 34' in substantially vertical relation.

Figure 10:
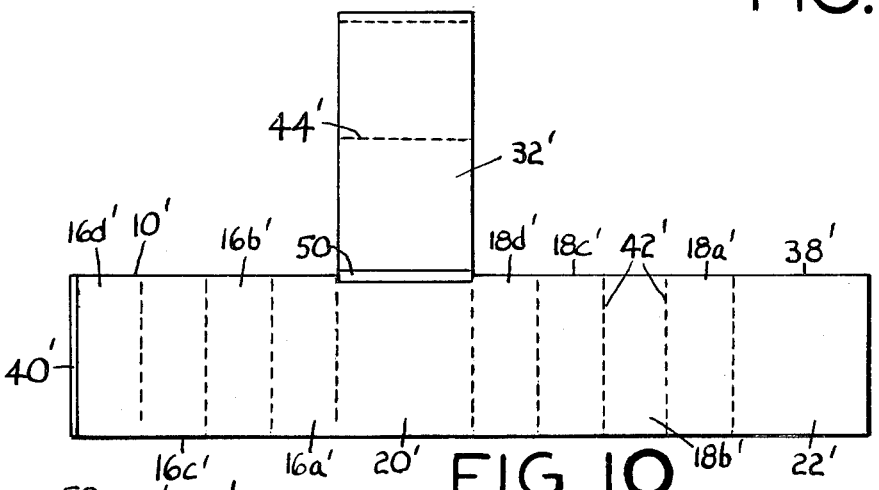
FIG. 10 is a plan view in reduced scale of blanks of material for forming the table.

With reference to FIG. 10, the table is formed of two pieces and can readily be supplied to the consumer in one piece by securing top 32' to the pedestal portion at the factory by strip 50. The pedestal member 10' is formed from a single blank 38' and is secured in tubular form by a strip of gummed tape 40' or other securing means at one corner. To provide for folding and shaping of the tubular portion at the corners and to form the inward curvature at the front and rear walls, the front wall 16' has a plurality of panels **16*a'*, 16*b'*, 16*c'* and 16*d'*. Likewise, the rear wall has a similar arrangement of panels 18*a'*, 18*b'*, 18*c'* and 18*d'*. The panels are connected to each other and to the side walls 20', 22' by bend lines 42'. The top wall has a longitudinal bend line 44'. The blank of FIG. 10 is substantially the same as that shown in FIG. 5 of the first embodiment except that it has connection to the top wall 32' and also the blank to form the tubular pedestal is joined between the panel sections 22' and 16*d'* by the connecting strip 40' instead of between panel sections 20 and 16*a***.

Figure 11:
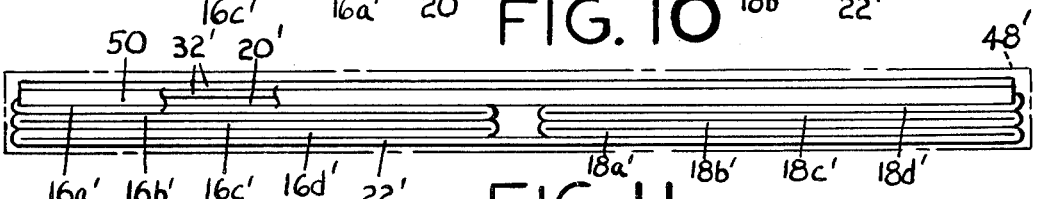
FIG. 11 is a top edge view of the table of FIG. 7 in folded flat condition and contained in a package.

With reference to FIG. 11, the panel sections are folded together in accordion-like arrangement so as to be contained in a package 48'. The top wall 32' is folded into overlapping relation with the pedestal sections along the side opposite from the panel section 22', this top wall being folded at the bend line 44' for packaging.

The top wall 32' has a grid 52 comprising lines extending in both directions and spaced at selected increments and also diagonal lines which may be used to measure or cut on the bias.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A portable, foldable table comprising (a) an open ended tubular pedestal member having top and bottom edges, the bottom edge being arranged for engagement on a supporting surface, (b) said pedestal member including front and rear walls joined to opposite side walls, (c) said walls having bend line connections for shaping said pedestal member between folded and unfolded conditions, (d) said front and rear walls each comprising a plurality of panels connected together by bend lines and being angular to each other in an accordion shape providing vertical structural strength and also providing inwardly extending recesses forming foot spaces for a person standing at the table, (e) the juncture of at least one of said side walls with respective adjacent panels of said front and rear walls in an unfolded condition of the table comprising an acute angular corner, (f) said front and rear walls being foldable into flat condition on said bend lines independent of each other in spaced relation in a folded condition of the table, (g) and a top wall on said pedestal member arranged to form an enlarged working surface, (h) said top wall including at least one downturned end tab projecting down into said acute angular corners in the unfolded condition of the table and being of a selected length to fit snugly between said front and rear walls at said corners to hold said pedestal member firmly in unfolded condition, (i) said top wall having an intermediate bend line whereby said top wall comprises a single layer unfolded panel in an unfolded condition of the table and overlapping panels in a folded condition of the table.

* * * * *